US008387982B2

(12) United States Patent
Howard et al.

(10) Patent No.: US 8,387,982 B2
(45) Date of Patent: Mar. 5, 2013

(54) GAMING DICE

(75) Inventors: Cephas Edgar Howard, Billund (DK); Ditte Bruun Pedersen, Billund (DK)

(73) Assignee: Lego A/S, Billund (DK)

( * ) Notice: Subject to any disclaimer, the term of this patent is extended or adjusted under 35 U.S.C. 154(b) by 179 days.

(21) Appl. No.: 12/865,953

(22) PCT Filed: Feb. 5, 2009

(86) PCT No.: PCT/DK2009/000029

§ 371 (c)(1),
(2), (4) Date: Nov. 29, 2010

(87) PCT Pub. No.: WO2009/097851

PCT Pub. Date: Aug. 13, 2009

(65) Prior Publication Data

US 2011/0101607 A1 May 5, 2011

(30) Foreign Application Priority Data

Feb. 5, 2008 (DK) ..... 2008 00153

(51) Int. Cl.
*A63F 9/04* (2006.01)

(52) U.S. Cl. ..... 273/146; 273/289; 273/290; D21/372; D21/373

(58) Field of Classification Search ..... 273/146, 273/289, 290; D21/372, 373
See application file for complete search history.

(56) References Cited

U.S. PATENT DOCUMENTS

| | | | | |
|---|---|---|---|---|
| 1,100,549 | A | 6/1914 | Elkins | |
| 3,608,906 | A * | 9/1971 | Odier | 273/157 R |
| 3,623,729 | A | 11/1971 | Wetherell | |
| 4,003,144 | A | 1/1977 | Maddestra et al. | |
| 5,306,198 | A | 4/1994 | Forman | |
| 2007/0200291 | A1 | 8/2007 | McEowen | |

FOREIGN PATENT DOCUMENTS

| | | |
|---|---|---|
| CH | 450254 | 1/1968 |
| CH | 686288 | 2/1996 |
| DE | 2 255 936 | 5/1974 |
| DE | 20316 447 U1 | 1/2004 |
| DE | 20 2005 001 584 | 4/2005 |

(Continued)

OTHER PUBLICATIONS

Notice of Reason for Rejection for JP Patent Application No. 2010-545356 dated Aug. 1, 2012; 1 page.

Web pages of "Lego Device", Original Works made from Lego Blocks dated Feb. 16, 1999; Accessed at URL: http://hwm3.gyao.ne.jp/clublego/origin/o_dice/dice.html; 18 pages.

(Continued)

*Primary Examiner* — Benjamin Layno
(74) *Attorney, Agent, or Firm* — Day Pitney LLP

(57) ABSTRACT

A gaming dice (1) and a game with a gaming dice (1), such as a board game or a card game, said gaming dice (1) comprising a body part comprising at least six sides (2) wherein at least one or more of those sides (2) is/are provided with means (3) for simultaneous mounting of at least two indicia-carrying elements (4*a*, 4*b*, 4*c*). This makes it possible to mount at least two separate indicia-carrying elements (4*a*, 4*b*, 4*c*), said indicia-carrying elements (4*a*, 4*b*, 4*c*) being configured such that they can be mounted next to each other on the same side of the gaming dice (1), and wherein the indicia-carrying elements (4*a*, 4*b*, 4*c*) have a bottom side on which means for mounting of the indicia-carrying element of the side (2) of the gaming dice (1) is configured and a top side which is opposite relative to the bottom side and is provided with indicia.

10 Claims, 1 Drawing Sheet

FOREIGN PATENT DOCUMENTS

| | | | |
|---|---|---|---|
| DE | 20 2005 006 329 | | 6/2005 |
| DE | 20 2007 006776 | | 7/2007 |
| JP | 3886995 | B2 | 2/2007 |
| WO | 95/13849 | | 5/1995 |
| WO | 01/03791 | | 1/2001 |

OTHER PUBLICATIONS

An English language translation of an Office Action dated Apr. 2, 2012, for corresponding Japanese patent application JP 2010-545356.

* cited by examiner

GAMING DICE

FIELD OF USE OF THE INVENTION

The present invention relates to a gaming dice for a game and a game, wherein the gaming dice comprises at least six sides, and wherein at least one or more of such sides is/are provided with means for mounting of an indicia-carrying element.

STATE OF THE ART

Gaming dice are used in the context of games of many different types, such as board games, card games and so on. For such games, cubic game dice with six sides of equal size and being essentially square are generally used, but gaming dice are known that have more sides than six depending on the number of outcomes desired by use of the gaming dice.

The most known embodiment of a six-sided gaming dice is configured such that each of the sides of the dice is provided with a number of dots or pips to the effect that a throw of dice may result in equal probabilities for the side facing upwards showing a number of pips from one to six.

Over the years, games have been developed that have entailed the need for gaming dice that may provide other outcomes than the above one through six pips, and thus gaming dice have been developed wherein some or all sides of the gaming dice is/are provided with other indicia than the known pips.

Besides, CH patent No. 450254 and 686288 and DE utility model No. 202005001584, U.S. Pat. No. 1,100,549 and PCT application No. 95/13849 teach gaming dice of the kind set forth in the introductory part, wherein the dice sides are configured with means for mounting indicia-carrying elements that can thereby be mounted, exchanged and varied with a view to configuring a gaming dice with precisely the desired outcomes that match a given game. These latter gaming dice thus enable the option of exchanging and adapting the indicia-carrying elements on the gaming dice to the effect that it is possible, by means of one single dice, to create far more possible outcomes when the dice is thrown. On the whole, the development of gaming dice has focused precisely on providing new options for games by enabling more different outcomes when the gaming dice is thrown.

OBJECT OF THE INVENTION

Based on this, it is the object of the present invention to provide a gaming dice and a game that enable further options for new kinds of games or more, options for different outcomes when the gaming dice is thrown.

This is accomplished in that the gaming dice comprises a body part configured with a number of sides on which the gaming dice may sit steadily when on a plane support, and wherein at least one or more of such sides is/are provided with means for mounting of an indicia-carrying element. According to the invention at least one side is provided with means for simultaneous mounting of at least two indicia-carrying elements.

Thus, it is possible to configure such gaming dice in such manner that eg elements of a toy building set can be mounted on the gaming dice; according to a preferred embodiment, however, the gaming dice further comprises at least two separate indicia-carrying elements that are configured such that they can be mounted next to each other on the same side of the gaming dice, and wherein the indicia-carrying elements have a bottom side on which means for mounting of the indicia-carrying element on the side of the gaming dice is configured and a top side which is configured opposite relative to the bottom side and is provided with indicia.

As mentioned above, the gaming dice according to the invention may be configured such that eg commonly known toy building elements can be mounted to the gaming dice, and wherein such toy building elements thereby act as indicia-carrying elements. According to a preferred embodiment, this can be accomplished if the means for mounting of the indicia-carrying elements on the gaming dice comprise complementary coupling means configured on the gaming dice and each of the indicia-carrying elements, respectively, said complementary coupling means being configured such that the indicia-carrying elements can be mounted on the body part of the gaming dice by frictional or geometrical interconnection. Advantageously, the complementary coupling means may comprise coupling studs and coupling flanges that are configured complementarily relative to the coupling studs, said coupling flanges being configured such that, frictionally or geometrically, they can be coupled onto one of the coupling studs.

The gaming dice according to the invention may thus advantageously be configured such that the coupling studs are configured on the sides of the body part of the gaming dice; and the complementarily configured coupling flanges are configured on the indicia-carrying elements whether such indicia-carrying elements are a part of the gaming dice or are constituted by components of a toy building set.

In this context, it would be expedient if the coupling flanges are configured on each of the indicia-carrying elements.

By configuring at least two separate coupling studs on at least one side of the gaming dice, it is further accomplished that each of these coupling studs may serve for mounting of one indicia-carrying element.

However, particularly advantageously, at least four separate couplings studs are provided on at least one side of the gaming dice; and wherein the coupling studs are configured in a square pattern to the effect that four adjacent coupling studs form corners in a square. Hereby it is accomplished that the indicia-carrying elements can be arranged in different positions relative to each other to the effect that the amount of possible outcomes obtainable with a dice can be varied further.

Obviously, the indicia-carrying elements can be configured in many possible ways, comprising elements that are essentially flat on their top sides and are provided with mutually different indicia, such as different shapes, ornamentations, colours or graphic prints.

According to the invention, the indicia carrying elements may comprise elements of different sizes to the effect that they can be mounted in such a manner as to cover varying numbers of coupling studs. Thus, elements may be provided that cover precisely one, two, three, four, or more coupling studs whereby further options are provided for varying the amount of possible outcomes obtainable by the gaming dice.

According to the most preferred embodiment, the gaming dice is provided as a cube with six sides of equal size and that are essentially square; wherein, on each side, at least four separate couplings studs are provided In a square pattern to the effect that four adjacent coupling studs form corners of a square.

LIST OF FIGURES

EMBODIMENT OF THE INVENTION

Figure 1:
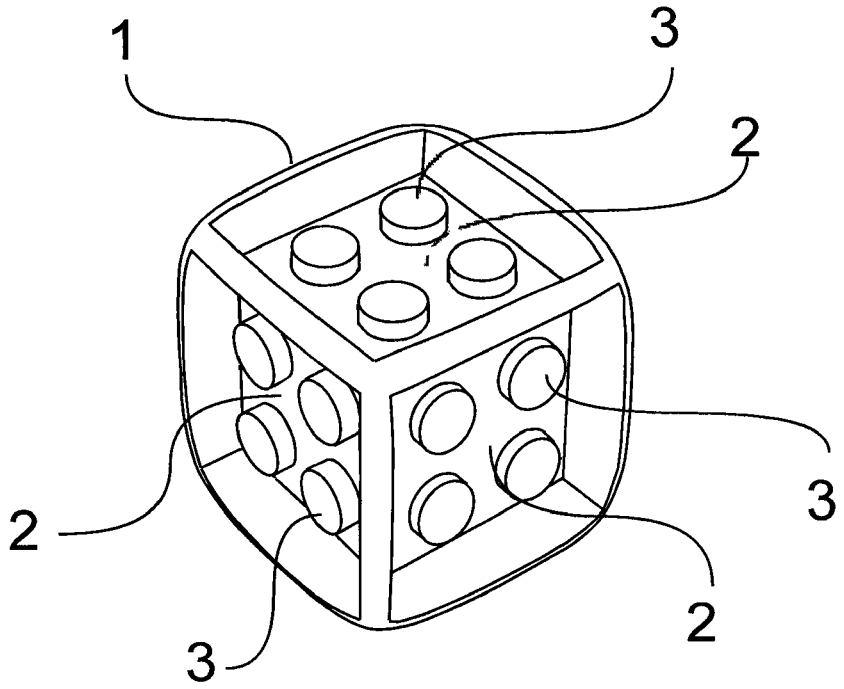
FIG. 1 is a perspective view of a gaming dice according to the present invention, seen in an inclined view from above.

Thus, FIG. 1 shows a gaming dice 1 according to the present invention, wherein the gaming dice 1 is of the most common type, wherein the gaming dice 1 has six identical sides 2, and wherein each of these sides 2 is configured to be essentially square to the effect that the probability of the gaming dice 2 coming to rest on a given side following throw of the gaming dice 1 is equally high for all the sides 2 of the gaming dice 1.

As shown in FIG. 1, the sides 2 of the gaming dice 1 are essentially identical and thus a throw of such gaming dice 1 will not in itself be meaningful, it not being possible for the user to distinguish between the outcomes of such throw of the dice. According to this preferred embodiment of the invention, four couplings studs 3 are therefore provided on each of the sides 2 and are arranged in a square pattern to the effect that the coupling studs 3 form corners in a square, and the coupling studs 3 are configured such that it is possible to mount building elements from a toy building system known per se on the coupling studs 3 to the effect that the sides 2 of the gaming dice are able to change nature upon mounting of different such building elements on the sides 2 of the gaming dice 1.

On the undersides of the building elements 4*a*, 4*b*, 4*c*, coupling flanges are configured that, following mounting of the building element 4*a*, 4*b*, 4*c* on the gaming dice 1, is in frictional abutment on the outer side of the coupling studs 3 on the gaming dice. There being ample opportunities for configuring such coupling flanges in different ways, and the person skilled in the art being able to freely point to such option, the building elements 4*a*, 4*b*, 4*c* are not shown in the figures.

By mounting different building elements on the gaming dice 1 according to FIG. 1, it is thus possible to impart to each side 2 of the gaming dice its own nature if the elements that are mounted on the gaming dice 1 vary in number, shape or appearance as such.

Figure 2:
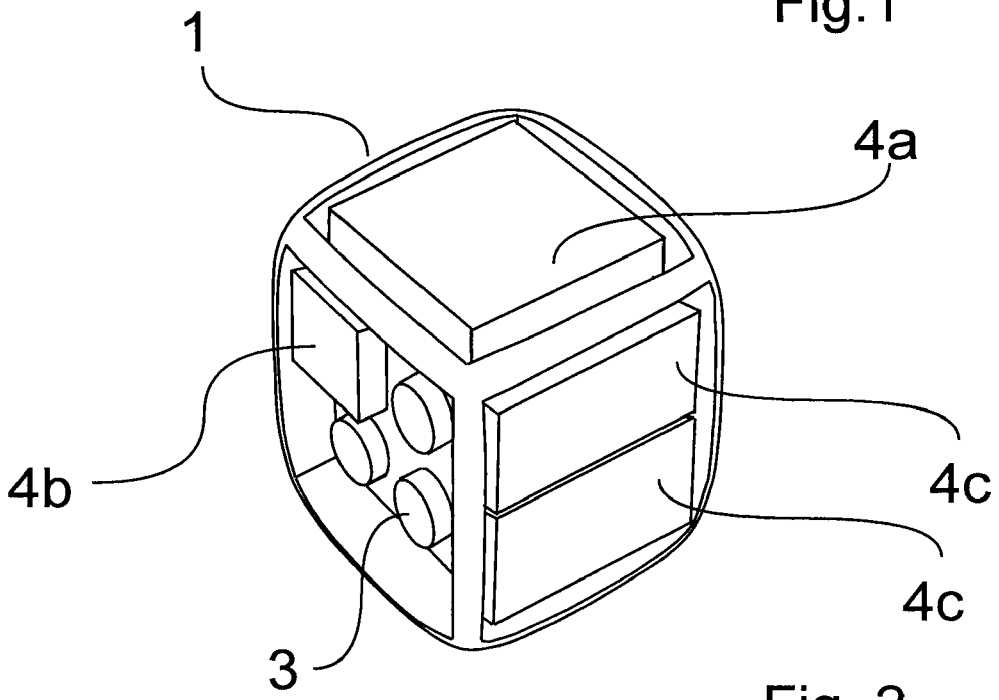
FIG. 2 is a perspective view of the gaming dice according to the invention shown in FIG. 1, seen in an inclined view from above, and wherein a number of indicia-carrying elements are mounted thereto.

Now, FIG. 2 shows the same gaming dice 1 as is shown in FIG. 1, and wherein, at least on the three visible sides 2 of the gaming dice, building plates 4, 4*b*, 4*c* from a toy building system known per se are mounted. On the one side that faces upwards, a square building plate 4*a* is thus mounted that covers all four coupling studs on the side 2 to the effect that the building plate does not leave space for mounting of further building elements on that side 2. On the two other visible sides 2 of the gaming dice 1, a single square building plate 4*b* is mounted that covers precisely one single one of the coupling studs 3 on the one side 2, and, on the other side 2, two rectangular building plates 4*c* are mounted that each covers precisely two coupling studs 3 on that side 2, respectively, to the effect that the two rectangular building plates 4*c* do not leave space for further mounting of building plates on that side 2.

In this way it is seen that, upon mounting of building plates, it can be achieved that all the sides of the gaming dice can be configured individually to the effect that the invention provides a large number of different options for building a gaming dice that is configured specifically for a particular game.

As set forth above, sides 2 on the gaming dice 1 can thereby the varied exclusively by mounting a different number of building plates on the gaming dice or by mounting building plates of different sizes. However, according to the present invention, it is also an option to vary the configuration of the sides 2 by varying the shapes, colours, ornamentations and/or printed motifs of the building elements.

According to the invention, the gaming dice 1 may thus comprise a number of different indicia-carrying elements 4*a*, 4*b*, 4*c* that may very well be configured in the same way as the above-mentioned building elements 4*a*, 4*b*, 4*c*, but are dedicated for use in varying the sides 2 of the gaming dice 1 by them being provided with indicia provided with different shapes, sizes, ornamentations, colours or motifs on the side that faces outwards when the indicia-carrying element 4*a*, 4*b*, 4*c* is mounted on one of the sides 2 of the gaming dice 1.

Thereby it is possible to accomplish that, by one single gaming dice, a very large number of different options is provided for designing the gaming dice 1 to the game it is desired to play or optionally to change the configuration and nature of the gaming dice 1 as a part of the game. This is accomplished by use of comparatively few individual components Obviously, the shown dice is of a preferred embodiment, and it is possible for the person skilled in the art to configure dice having other basic shapes than the one shown, but wherein the fundamental principle of the invention is applied. For instance, the invention can be used for dice that feature more sides than six, like the one shown in the figures, or wherein the sides have other shapes than the square ones shown. A dice in the shape of a teetotum which, when it topples, will settle on a side could also be used as basic shape for a dice according to the present invention.

The invention claimed is:

1. A reconfigurable gaming dice for a game, said gaming dice comprising:

a) a body having at least six sides on which the gaming dice may sit steadily when on a plane support, and wherein at least one of the sides is provided with a plurality of coupling studs that project outwardly for mounting of an indicia-carrying element thereon, wherein at least one side is adapted to receive at least two indicia-carrying elements thereon; and b) at least two indicia carrying elements disposed on the studs, wherein the indicia-carrying elements are elements of different sizes and shapes, and wherein the indicia-carrying elements can be mounted in such a manner as to cover varying numbers of the coupling studs, and further the body is adapted and configured to prevent the indicia carrying elements from making physical contact with the plane support when the gaming dice is in use.

2. A gaming dice according to claim 1, wherein the indicia-carrying elements are configured such that they can be mounted next to each other on the same side of the gaming dice, and wherein the indicia-carrying elements have a bottom side on which a recess for mounting of the indicia-carrying element on the side of the gaming dice is configured and a top side on which is configured opposite relative to the bottom side and is provided with indicia.

3. A gaming dice according to claim 2, characterised in that the means for mounting the indicia-carrying elements on the gaming dice comprises complementary coupling means configured on the gaming dice and each of the indicia-carrying elements, respectively, said complementary coupling means being configured such that the indicia-carrying elements can be mounted on the body part of the gaming dice by frictional or geometrical interconnection.

4. A gaming dice according to claim 3, wherein the complementary coupling means includes coupling flanges on the indicia-carrying elements that are configured complementarily relative to the coupling studs, said coupling flanges being configured such that, frictionally or geometrically, they can be coupled onto one of the coupling studs.

5. A gaming dice according to claim 4, characterised in that the coupling studs are configured on the sides of the body part of the gaming dice; and that the complementarily configured coupling flanges are configured on the indicia-carrying elements.

6. A gaming dice according to claim 5, characterised in that the coupling flanges are configured on each of the indicia-carrying elements.

7. A gaming dice according to claim 5, characterised in that at least two separate coupling studs are configured on at least one side of the gaming dice.

8. A gaming dice according to claim 7, characterised in that at least four separate couplings studs are provided on at least one side of the gaming dice and wherein the coupling studs are configured in a square pattern to the effect that four adjacent coupling studs form corners in a square.

9. A gaming dice according to claim 7, characterised in that the indicia-carrying elements comprise elements that are, on their top face, provided with indicia that differ from each other, e.g. have different shapes, ornamentations, colours, or graphic prints.

10. A gaming dice according to claim 1, characterised in that it is configured as a cube with six sides of equal size and that are essentially square; wherein, on each side, at least four separate couplings studs are provided in a square pattern to the effect that four adjacent coupling studs form corners of a square.

* * * * *